US005267870A

United States Patent [19]

Maresh

[11] Patent Number: 5,267,870

[45] Date of Patent: Dec. 7, 1993

[54] CHILDPROOF ELECTRICAL RECEPTACLE

[76] Inventor: Joseph D. Maresh, 19919 White Cloud Cir., West Linn, Oreg. 97068

[21] Appl. No.: 864,473

[22] Filed: Apr. 6, 1992

[51] Int. Cl.[5] ..... H01R 13/453; H01R 13/447

[52] U.S. Cl. ..... 439/139; 174/67; 439/137

[58] Field of Search ..... 439/136–139; 174/67

[56] References Cited

U.S. PATENT DOCUMENTS

| | | | |
|---|---|---|---|
| 2,545,536 | 3/1951 | Von Holtz | 173/330 |
| 2,752,581 | 6/1956 | Benander | 439/139 |
| 3,363,215 | 1/1968 | Smith | 339/14 |
| 3,980,372 | 9/1976 | Ranzanigo | 439/139 |
| 4,037,901 | 7/1977 | Kaszuka | 439/138 |
| 4,206,957 | 6/1980 | Ludwig | 339/40 |
| 4,379,607 | 10/1980 | Bowden, Jr. | 339/40 |
| 4,586,765 | 5/1986 | Ban | 339/44 |
| 4,768,965 | 9/1988 | Chang | 439/137 |

*Primary Examiner*—Paula A. Bradley

[57] ABSTRACT

A wiring device or receptacle having a rotatable or slidably mounted shutter for blocking entrance of the positive prong of a power plug into the hazardous, positive receptacle slot unless the neutral prong of the power plug has actuated the shutter to the open, positive prong passing position. The neutral receptacle slot length is increased to allow the shutter to be actuated in a direct manner upon contact and subsequent applied force against the shutter in the slot length direction, in order for the shutter to be actuated to the open, positive prong passing position.

14 Claims, 13 Drawing Sheets

CHILDPROOF ELECTRICAL RECEPTACLE

BACKGROUND

1. Field of the Invention

This invention relates to electrical receptacle and more particularly, to an electrical receptacle which contains a shutter behind the receptacle slots, which must be oriented to an open position to allow full insertion of an electrical plug. This receptacle is of a design childproof in nature.

2. Description of Prior Art

Electricity, as a source of power, has been present in American households for over a century. Electrical appliances utilize this power to perform specific functions ranging from illumination, entertainment, information handling, and/or a wide variety of work tasks. The most common means to connect the electrical device to the source of power; apart from hard wiring the device directly into the electrical circuit, is to use what has become known as electrical receptacles. These electrical receptacles consist of electrically energized female contacts into which pronged plug members of the electrical device must be inserted.

Receptacles of this nature have long been recognized as a potential source of shock hazards to children who intentionally, out of curiosity, insert metallic objects into the receptacle slots. As a result, a very large number of safety receptacles have been invented to reduce this danger. One safety receptacle version which has been invented contains a shutter behind the receptacle slots which allow entry of the pronged electrical plug only if all plug prongs are inserted simultaneously. This eliminates the possibility of a child intentionally probing the electrical contacts with a singular object. Such a receptacle shutter mechanism may be found in U.S. Pat. No. 4,379,607, Wade R. Bowden. The shutter mechanism utilized in this safety receptacle version consists of two interdependent, cam integrated, plug prong actuated members which open during insertion of the plug. These receptacles serve the purpose described, but are limited in marketing aspects due to high manufacturing expenses and poor durability.

Other childproof receptacles proposed contain a sliding or rotating flat member which moves in a plane parallel with the face plate of the receptacle. Such a member has slots incorporated within it which must be aligned with the slots of the electrical contacts. This category is fairly large with distinctions between manually movable members such as U.S. Pat. No. 4,206,957, Melvin S. Ludwig; or U.S. Pat. No. 4,768,965, Yen C. Chang, or automatic barriers which move as a result of contact between an angled cam surface, and the ends of the entering plug prong or prongs. An example of such a design may be illustrated by U.S. Pat. No. 2,545,536, Charles T. Von Holtz. Note that with these designs, a singular metallic object may be inserted into any one of the electrical receptacle contacts, although the procedure to do so may be beyond the normal capability of a child.

Additionally, there are further distinctions among cam style versions as pertaining to the ability of the receptacle to allow, or disallow entry of the plug based upon whether a third ground prong may or may not be present. An example of such a design utilizing a pivoting cam surface to do so may be found with U.S. Pat. No. 3,363,215, Clarence M. Smith.

Furthermore, completely different approaches may be discovered when searching for safety receptacles. Some of these products are essentially standard receptacles housed within some type of enclosure or box like structure which reduces the likelihood of children gaining access to the live contacts. An example of such a design is illustrated by U.S. Pat. No. 4,586,765, Thomas E. Ban. Another product, which is perhaps the most widely used method to reduce shock hazards from electrical receptacles to children, would involve the insertion of a plastic, nonconducting dummy plug into the receptacle slots. This blocks entry of an object into the receptacle slots in an economical, although cumbersome manner.

Finally, inconsequential to this invention, one other device used to prevent possible fatal electrical shocks is to wire the circuit to a device known as a ground fault circuit interrupter. This is a very useful device, but suffers a serious drawback because although it will protect against line to ground faults, it will not protect against line to line hazards. Such line to line shocks may occur when a finger (or fingers) of an ungrounded person is simultaneously in contact with both the neutral, and positive plug prongs. The current in both lines while the shock under this scenario is being experienced is equal, as when any electrical load is present; and in order to trip the device off, a line to line imbalance of approximately five milliamperes must be present. Threshold settings below this value are likely to cause occasional nuisance tripping of the device due to cumulative tool/appliance leakage or leakages from extremely long circuits. Typical response time of ground fault circuit interrupters is one fortieth of a second.

Two other drawbacks of ground fault circuit interrupters are that a power plug insertion technique is not required, and that these devices can be relatively expensive for the consumer.

SUMMARY OF THE INVENTION

This invention departs from all those previously mentioned in both concept and electrical theory recognition. It is understood from the foregoing discussion that the primary intent of this invention is to reduce the likelihood of electrical shocks to children who intentionally, out of curiosity, insert a metallic object into the receptacle slots. The receptacles which are the object of this invention are those which are commonly utilized in American households and provide 120 volts of electrical potential.

For the purpose of this discussion, let us assume that these receptacles have three slots at each plug location. One of these three slots is the electrical ground terminal which is characterized as the voltage potential of the earth. This terminal presents no shock hazard. The other two terminals are usually referred to as the live terminals. Of these two terminals, the positive terminal is at an electrical potential of approximately 120 volts, which is sufficient to exhibit a significant shock hazard provided a circuit to a lower voltage potential may be completed. Such may be provided by a person, if the person in contact with this terminal has some portion of his/her body in contact with an object at a lower voltage potential. In this case, the portion of the persons body generally between the two contact points becomes the portion of the circuit to be completed. Thus, the person completing this circuit experiences a shock at this portion of his/her body.

The remaining terminal to be discussed is known as the neutral terminal. The shock hazards normally presented with this terminal is negligible because the voltage present relative to ground is approximately zero. In fact, the only reason this terminal would present any significant shock hazard would be if the wiring of the circuit was incorrectly reversed, or there is a dead short in the circuit. It is assumed that neither of these two scenarios is present.

This invention utilizes the neutral terminal or slot as a shutter access gate. This neutral slot is enlarged in a vertical direction into which the neutral plug prong is to be partially inserted into the receptacle, as to contact an edge of a shutter. After this neutral prong has made contact with this shutter edge, the prong is to be forced in a vertical direction, to thereby force the shutter open. In the simplest embodiment of this invention, as the neutral prong finds the neutral slot, the positive prong is simultaneously exposed to the positive slot due to contained vertical sliding of the shutter member.

An alternative motion for the shutter member to be subjected to as the neutral plug prong forces it open during vertical actuation is pivotal, or rotational in nature. In two of the embodiments, the shutter may pivot about a central point located on center, and directly between the neutral and positive slots. This will cause the portion of the shutter blocking the neutral terminal to swing upward while the portion of this same shutter blocking the positive terminal will swing downward. These embodiments, or variations thereof, are considered preferred and are compatible with receptacles equipped with or without the additional ground terminal. It is interesting to note that it is a fortunate coincidence that the geometry and dimensions of a standard household receptacle will allow the selection of these two embodiments; because if the ground terminal slot had been located closer to the two live terminals, dimensional constraints would prohibit their use.

Regarding the general application of a pivotal shutter member, it is also possible to pivot the shutter about an alternate point such as the center of the ground prong hole. This design would require a hole or slot to be present in the shutter member which will become aligned with the receptacle positive terminal slot during power plug insertion.

Several important advantages or distinctions exist with this invention. The first to be mentioned is that if an attempt is made to probe a metallic object into the positive (electrically 'hot') terminal slot, one would be unable to make entry because the shutter is closed, and the shutter edge or ledge is inaccessibly located behind the receptacle cover at this positive terminal slot. During a probing attempt, one would simply encounter the smooth surface which lies in a plane parallel to the receptacle cover. The second advantage or distinction to be noted is that if an attempt is made to probe into the neutral slot, access would only be gained if the probing object first pries open the shutter by catching the probe on the accessible edge of the shutter within the neutral terminal slot. Once access has been gained, and the probe is in contact with the neutral terminal contacts, an electrical shock would not be experienced because the neutral terminal is at approximately zero voltage. The third advantage or distinction to be noted with this invention is that power plug insertion requires a technique. The technique is to slide the neutral prong of the power plug against the shutter to thereby open it, followed by full insertion of said power plug. This technique is desirable in a childproof sense because it is generally not recommended to allow children to insert power plugs into receptacles, and thereby power up potentially dangerous appliances. With this invention, the likelihood of children doing so is reduced because of the required learned technique.

A fourth significant advantage with this invention is that the designs of the embodiments to follow, although illustrated conservatively, actually require minimal depth dimensions as compared to childproof designs of prior art. This is significant because reduction of frontal cover member depth ensures adequate electro-mechanical engagement of each of the power plug prongs with the electrical receptacle sockets.

Finally, a comment should be made regarding the appropriateness of this invention in light of the advent of polarized receptacles. Polarized receptacles have terminal slots dimensioned to prevent improper insertion of polarized power plugs. The neutral terminal slot of a standard polarized receptacle is vertically (and symmetrically) elongated beyond that of the positive terminal slot in order to accommodate the wide neutral prong of a polarized power plug. This vertically wide neutral plug prong is too wide to enter the positive receptacle terminal slot. This is a feature primarily intended to guarantee that the appliance being connected to the power supply is connected to the proper electrical polarity in order to ensure the appliance frame or housing is essentially grounded. The greater elongation of the neutral receptacle slot which is required with this invention is a logical extension of this polarization concept.

These and other advantages or objects of the invention will become apparent upon consideration of the following detailed description along with the attached drawings, in which.

DESCRIPTION OF THE PREFERRED EMBODIMENTS

Figure 1:
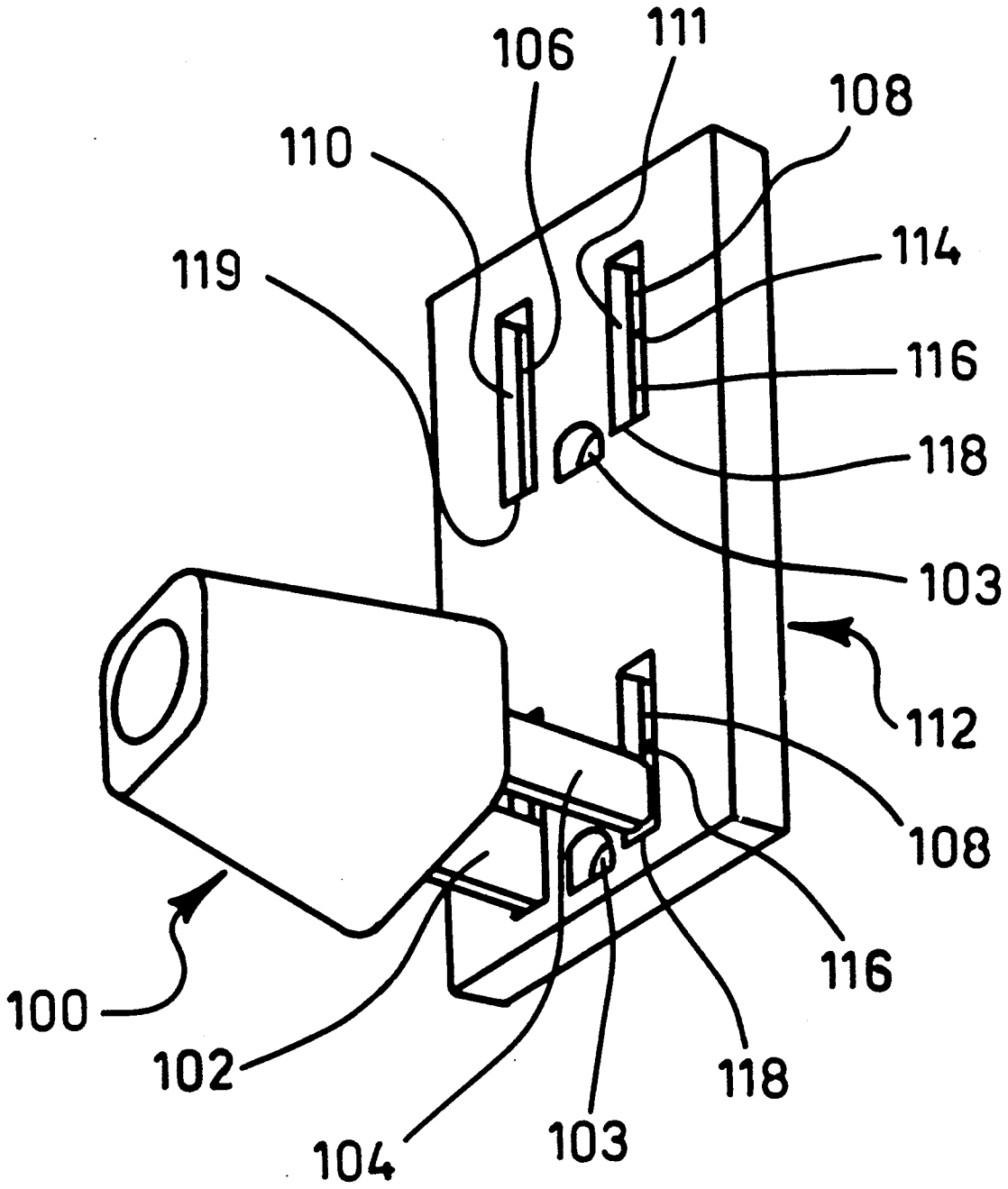
FIG. 1 is an assembled front perspective view of the receptacle frontal cover member pertaining to the cited embodiments of this invention, also illustrated in this figure is a polarized power plug, with prongs of equal protruding lengths, at an early stage of the power plug insertion technique.

Referring now to the figures, I have illustrated in FIG. 1 a front perspective view which may represent the all of the cited embodiments. Shown also in this figure is a standard 'polarized' power plug during the early stage of the plug insertion technique. This invention may be incorporated within the frontal cover member 112 of a standard duplex electrical receptacle housing assembly 160 shown only in FIG. 8, of applicable dimensions consistent with Underwriters Laboratory. Continuing with FIG. 1, power plug 100 has a wide neutral prong 102, and a narrow positive prong 104. Because two different prong widths are present, we may refer to this power plug 100 as 'polarized'. Power plug 100 may also contain an unillustrated male type ground prong which would mate with the ground prong hole 103 during power plug insertion.

In describing frontal cover member 112, we have neutral prong slot 106 which has been elongated vertically the full depth of this frontal cover member 112, to over twice the vertical distance of the power plug neutral prong 102. Slot chamfer 110 is present throughout the total vertical distance of neutral prong slot 106. Spaced a standard distance to one side of this neutral prong slot 106 is the positive prong slot 108. This positive prong slot 108 has been elongated by only a limited depth to a similar vertical distance as the elongation of the neutral prong slot 106. The depth to which the positive prong slot 108 has been elongated would correspond with the depth of slot chamfer 111. It may be seen that because positive prong slot 108 has been elongated to a shallow depth only, a step or ledge 114 consisting of a horizontal plane has been defined which corresponds with the bottom side of positive prong slot 108. This may be best illustrated by referring to FIG. 2. Continuing with FIG. 1, and referring to ledge 114, it may be seen that the shallow elongation of positive prong slot 108 results in a positive slot groove of which the trench bottom may be defined at 116. This trench bottom 116 connects the forward extremity of ledge 114 to the rear extremity of bottom positive groove end 118.

Figure 3:
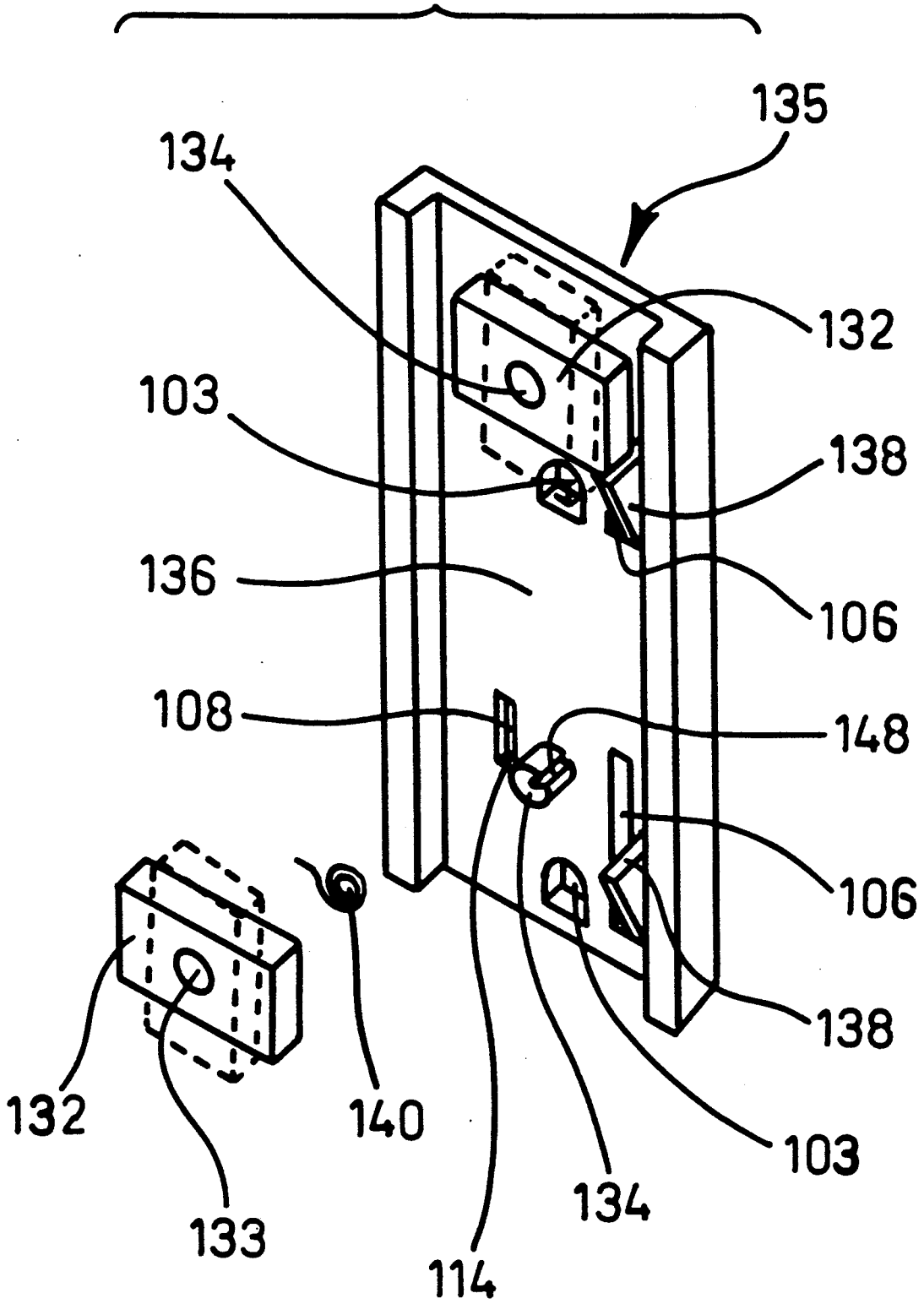
FIG. 3 is a reverse perspective view of the receptacle frontal cover member pertaining to the first embodiment, shown with the upper portion assembled, and the lower portion exploded.

The technique of power plug insertion through the frontal cover member of the embodiments illustrated requires the neutral prong 102, of the power plug 100, to be inserted into the neutral prong slot 106 adjacent to the bottom neutral slot side 119 until the end or point of said neutral prong 102 contacts the underside of the shutter member 132 illustrated in FIG. 3. Simultaneously, positive plug prong 104 shall be advanced until contact occurs between end or point of positive plug prong 104 to positive slot trench bottom 116. Positive plug prong 104 will be adjacent to bottom positive groove end 118 at this instance. Furthermore, as illustrated in FIG. 1, power plug 100 at this stage is no longer perpendicular with the frontal cover member 112. The trench bottom 116 presents a barrier to power plug positive prong 104 early in the technique of power plug insertion, and effectively causes the power plug to tilt or swing about the point or end of power plug positive prong 104 because the power plug neutral prong 102 is allowed to advance further into the frontal cover member 112.

Figure 2:
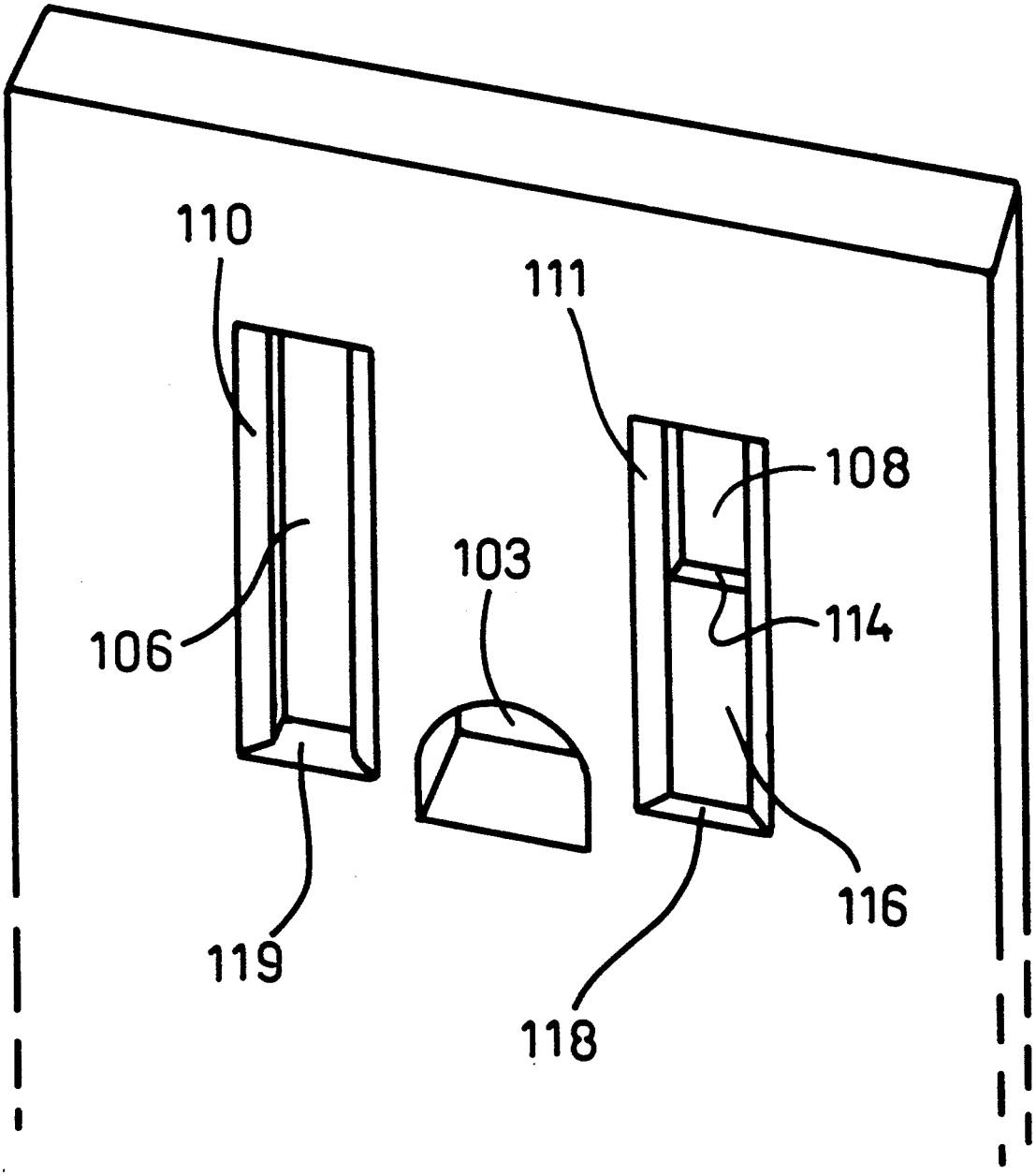
FIG. 2 is a frontal enlarged view from a different perspective of the cited embodiments of this invention, and is similar to FIG. 1.

This technique of power plug insertion may be further understood by referring to FIG. 2, which illustrates the slot regions of FIG. 1, but in an enlarged fragmentary frontal view of different perspective. Referring to FIG. 2, similar reference numbers are used as in FIG. 1, where 103 is the ground prong hole, 106 is the neutral slot with neutral slot chamfer 110 and bottom neutral slot side 119. Positive prong slot is shown as 108, in addition to ledge 114, positive slot chamfer 111, positive slot trench bottom 116, and bottom positive groove end 118.

Continuing and referring now to FIG. 3, a reverse perspective view of frontal cover member 112 is shown with the upper shutter 132 installed, and the lower shutter 132 separated away from the installed location. In order to open the shutter member 132, power plug neutral prong 102, shown in FIG. 1, must contact and vertically force shutter member 132 upward behind neutral slot 106, and consequently cause the shutter to pivot or rotate until the plug neutral prong 102 has reached the uppermost position within the neutral prong slot 106. The shutter 132 will thus pivot at circular shutter hole 133 about protruding axle 134. At this instant, both the neutral and positive prongs 102 and 104 respectively of the power plug shown only in FIG. 1 will become aligned with the receptacle electrical sockets, and power plug may be advanced directly inward to achieve electrical contact. The protruding axle 134 extends rearward from the back side 136 of frontal cover member 135, and is approximately centrally located in each the vertical and horizontal directions between the power plug neutral and positive prong slots 106 and 108 respectively, as illustrated in the lower exploded portion of FIG. 3.

Continuing in general with FIG. 3, a spring 140 may be employed to bias the shutter member 132 to a closed position. Shutter stop 138 is incorporated within the design of the rear surface 136 of frontal cover member 135 in order to prevent the shutter member 132 from closing beyond the normally closed position.

Continuing with the lower exploded portion of FIG. 3, positive terminal ledge 114 is illustrated and shown to be identical in dimensions and application to the ledge 114 illustrated in FIG. 1 and FIG. 2. This ledge 114 shields the underside portion of pivoting shutter 132 in the vicinity of the positive slot, thus preventing the possibility of opening said pivoting shutter 132 by entry or probing of any object into this respective positive terminal slot 108. Also, note that power plug positive prong 104 is not allowed to contact lower edge of shutter member 132, when said shutter is in the closed position, because said edge of shutter member 132 is shielded from positive prong 104 by positive slot trench bottom 116 shown in FIG. 1 and FIG. 2.

Figure 4:
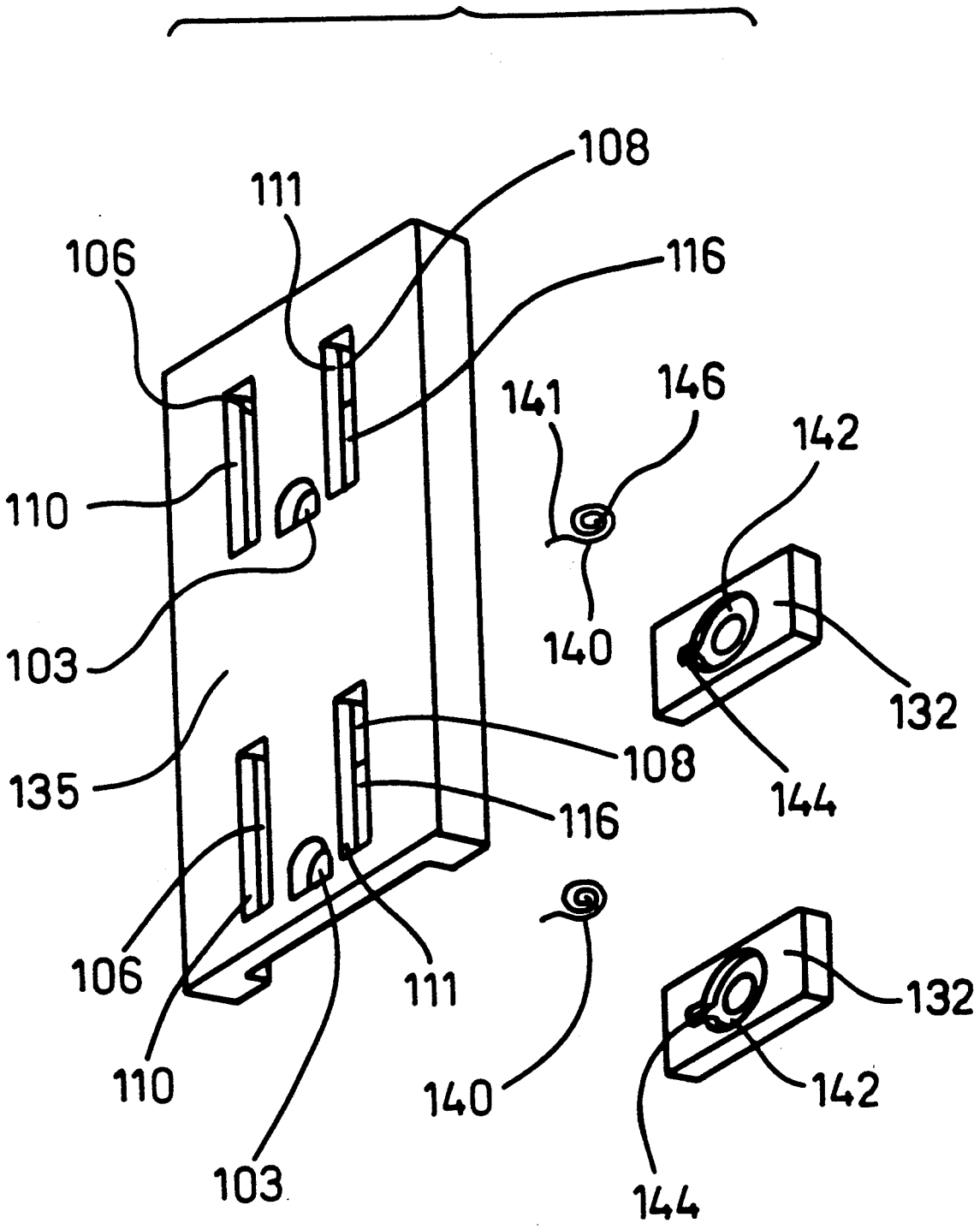
FIG. 4 is a front exploded perspective view of the receptacle frontal cover member pertaining to the first embodiment.

Directing ones attention now to FIG. 4, pivoting shutter members 132 of this first embodiment contain a cavity 142 provided for the purpose of enclosing spiral torsion spring 140. This helical torsion spring 140 has distal end 141 which extends radially outward to engage mortise 144 serving as a torsion transmission point between spring distal end 141 and pivoting shutter 132. Opposite spring distal end 146 extends radially inward to engage protruding axle key slot 148 illustrated in FIG. 3. This protruding axle key slot 148 allows distal spring end 146 to react to an immovable surface, thereby transmitting torsion, in the course of returning the shutter 132 to the normally closed position after the power plug has been withdrawn from the frontal cover member. As should be noted, alternative spring designs suitably engineered may also be employed with this embodiment to accomplish the same function.

Figure 5:
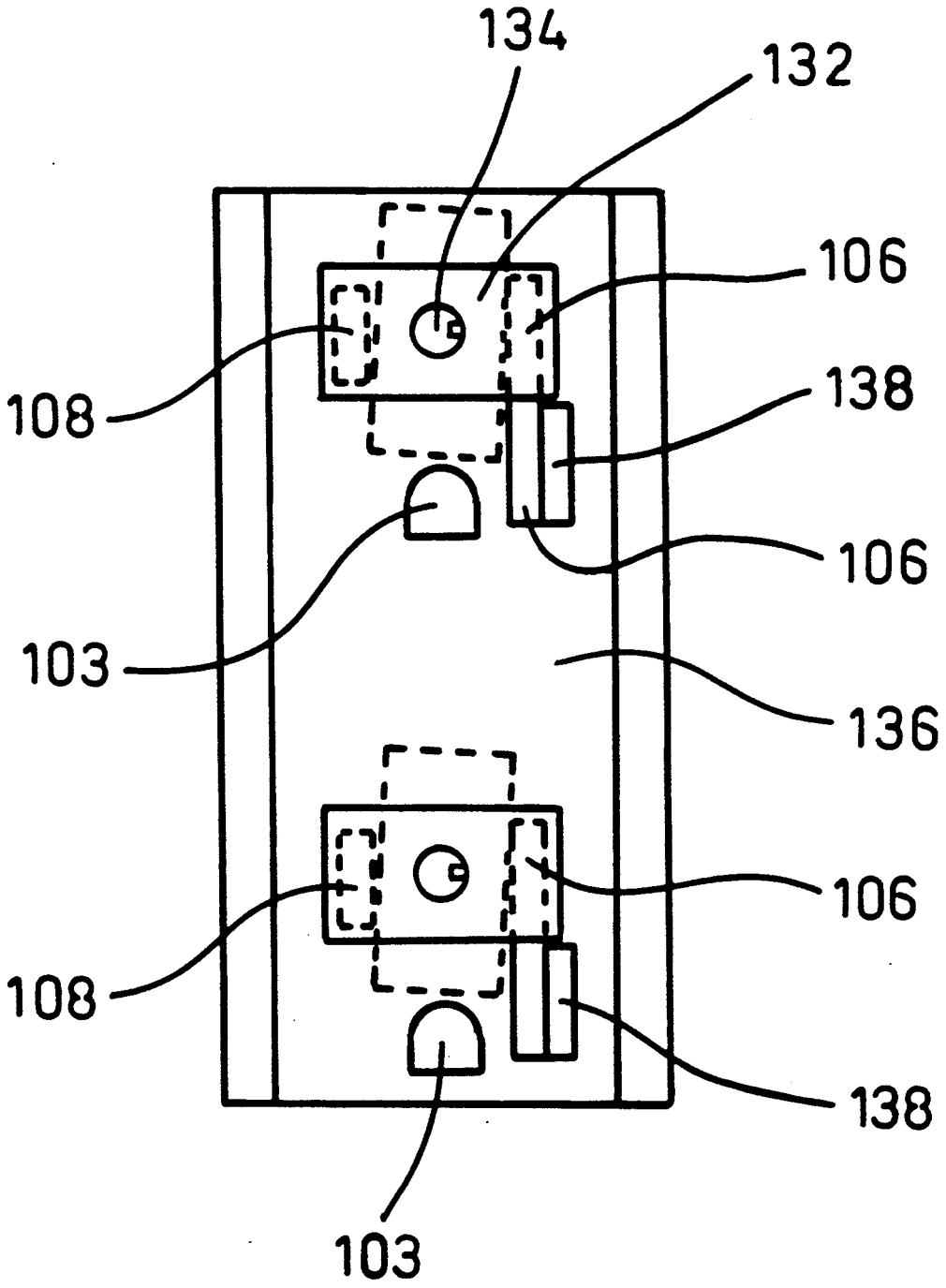
FIG. 5 is an assembled rear plan view of the first embodiment.

Continuing now with FIG. 5, we see illustrated a rear plan view of this first embodiment. Rear surface 136 of frontal cover member is directed toward the reader. Shutter member 132 is again shown with solid lines representing the normally closed position, and with phantom lines representing the shutter open position. Phantom lines also represent neutral slot 106, and positive slot 108. Upon careful examination, and as noted earlier, the reader may find it interesting that geometrical relationships relative to the terminal slots of standard electrical duplex receptacles coincidentally allows this embodiment of the invention to be employed.

Continuing with FIG. 5, and describing the principal parts illustrated, we have protruding axle 134 described earlier as an axle about which shutter 132 pivots. The elongated portion of neutral prong slot 106 is shown extending below the underside of shutter 132. The lower region shown of neutral prong slot 106 is that which the power plug neutral prong 102 must enter, prior to contact and subsequent applied upward force of the neutral prong 102 against the proximal underside of shutter 132, during the technique of power plug insertion. Spring biased closure of shutter 132 is illustrated in contact with shutter stop 138. Ground prong hole 103 is shown in this plan view as permitting unrestricted entry of unillustrated power plug ground prong.

Figure 6:
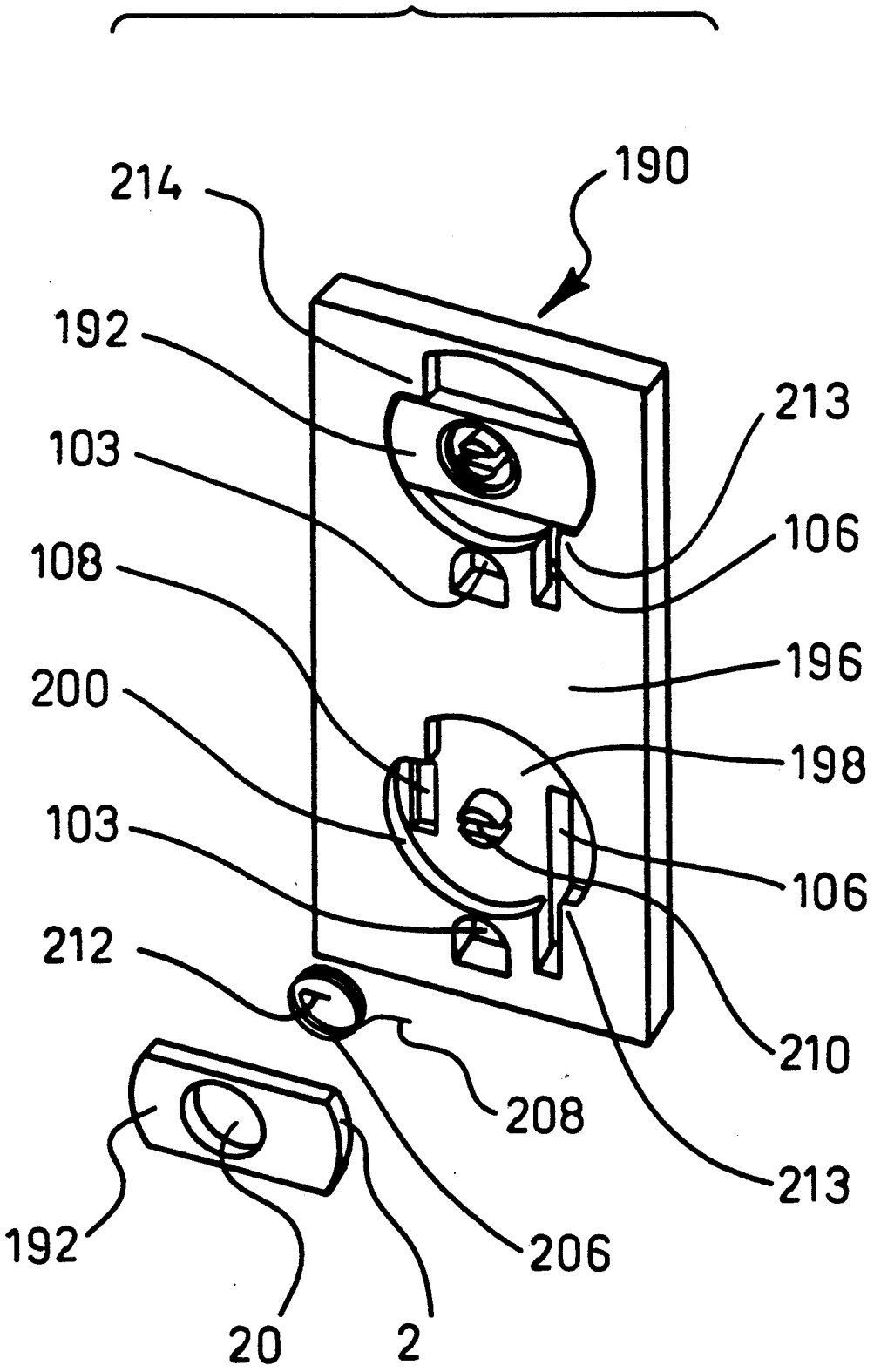
FIG. 6 is a partially exploded rear perspective view of the second embodiment.

Referring to FIG. 6, a reverse perspective view is shown of the second embodiment. This may be considered as the most favored embodiment. As with FIG. 3, the upper half of FIG. 6 is shown with the rotatable shutter 192 installed, while the lower half of this figure is illustrated with an exploded presentation. Elongated neutral slot 106 extends through frontal cover member 190 voiding all intersecting portions therewith.

Referring now primarily to the lower portion of FIG. 6, rear surface 196 of frontal cover member 190 has a double radius circular recess incorporated within it into which the recess bottom 198 extends to a depth of the approximate thickness of the rotational shutter 192. Circumferential recess walls 200 encircle the shutter arcuate ends 202 in order to capture the shutter 192 in shutter radial directions while the shutter is stationary or subject to rotation. Frontal side of shutter 192 is juxtaposed to recess bottom 198 when in the assembled location. Shutter 192 has a circular hole 204 centrally located therein and of dimensions substantially greater than protruding anchor 210, passing between the front and rear side of the shutter as to avail the installation and location of a torsion spring 206 for the purpose of biasing the shutter to a closed position. Torsion spring 206 is affixed at one distal end 208 to shutter anchor 209, illustrated only in FIG. 7 with phantom lines, and at opposite distal end 212 to the protruding anchor 210. Continuing with FIG. 6, when the shutter has been biased by the torsion spring 206 to the closed position, the shutter will contact the underside of upper shutter stop 214 and lower shutter stop 213, which serves to prevent the shutter 192 from closing beyond the normally closed position.

Figure 7:
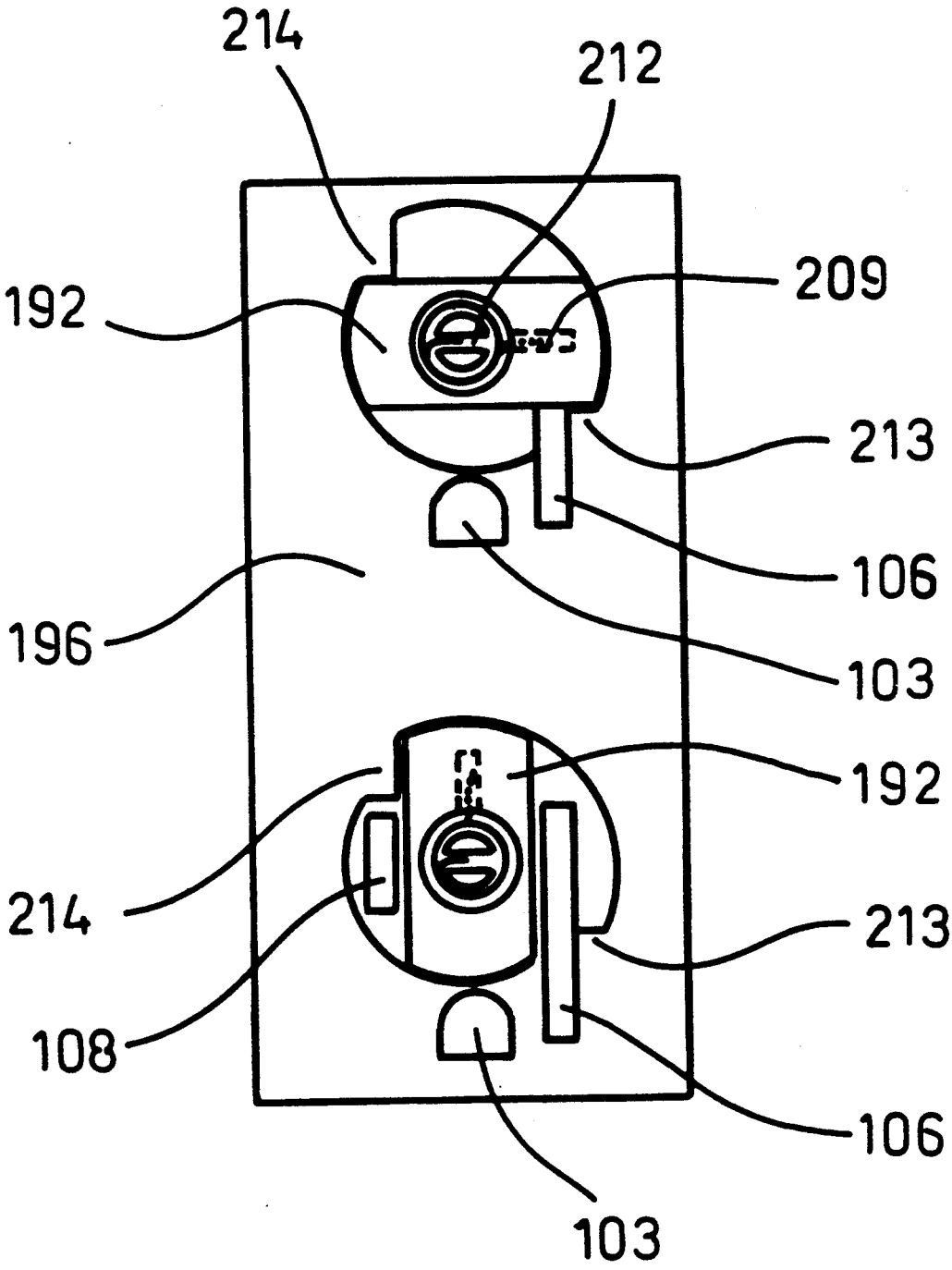
FIG. 7 is a rear plan view of the second embodiment.

Referring now to FIG. 7, a rear plan view is shown of FIG. 6 where the rear surface 196 of frontal cover member is directed toward the reader. The upper shutter 192 is illustrated in the normally closed position, and in the lower portion of this view, it is illustrated in the biased open position. Shutters 192 are asymmetrical in configuration in order to allow contact with upper shutter stop 214, and lower shutter stop 213. Torsion spring 212 is shown with distal end 208 engaged with shutter anchor hole 209, and opposite distal end 212 engaged with protruding anchor 210. Neutral slot 106 and positive slot 108 is shown clearly in the lower portion of this view to be unobstructed by the shutter. Ground prong hole is illustrated as 103.

Figure 8:
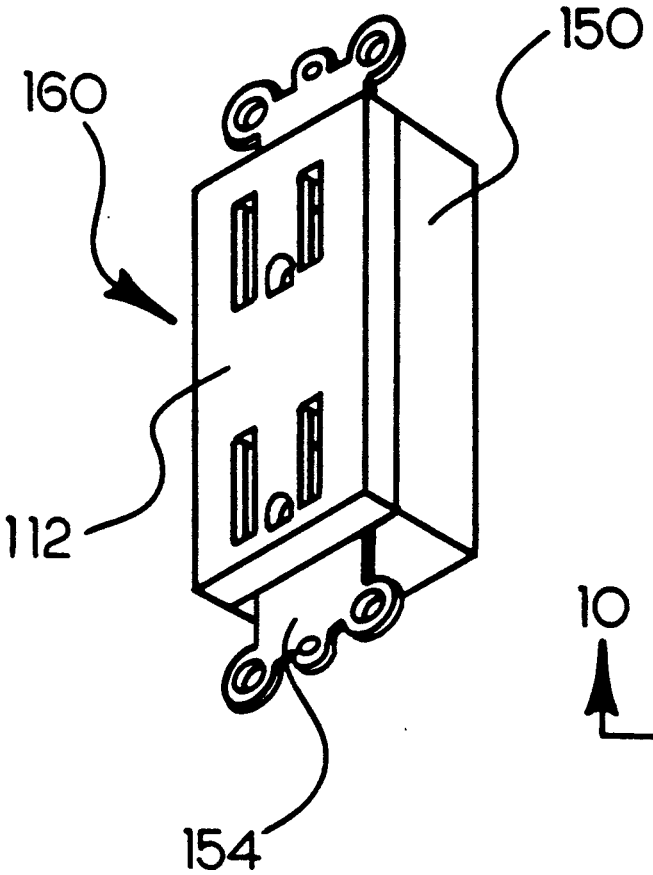
FIG. 8 is an assembled front perspective view of the cited first, second, third, and fourth embodiments showing the receptacle assembly, including the complete frontal cover member attached to a receptacle housing.

Discussing now FIG. 8, which may in general represent any of the cited four embodiments, frontal cover member 112 is illustrated mounted to a receptacle housing 150, thereby forming receptacle housing assembly 160. Receptacle housing 150 has incorporated within it unillustrated power plug slots which are in alignment with the neutral, positive, and ground slots 106, 108, and 103 respectively, shown in the frontal cover member 112 of FIG. 1. Receptacle housing 150 is secured to frontal cover member 112 by rivets, screws, or adhesive. Yoke 154 is rigidly secured to receptacle housing 150 and is provided to facilitate attachment of receptacle housing assembly 160 to an unillustrated electrical wall box.

Figure 9:
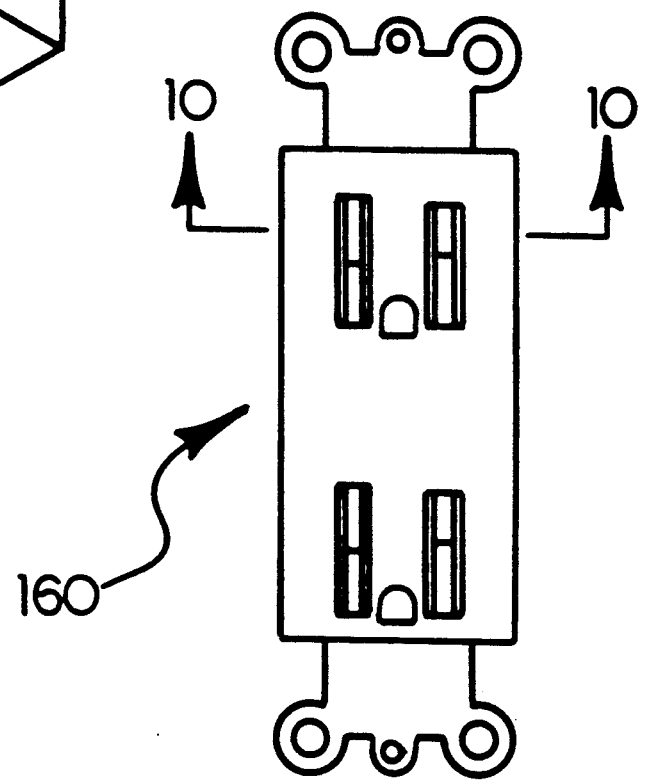
FIG. 9 is a front plan view of the receptacle assembly shown in FIG. 8.
Figure 10:
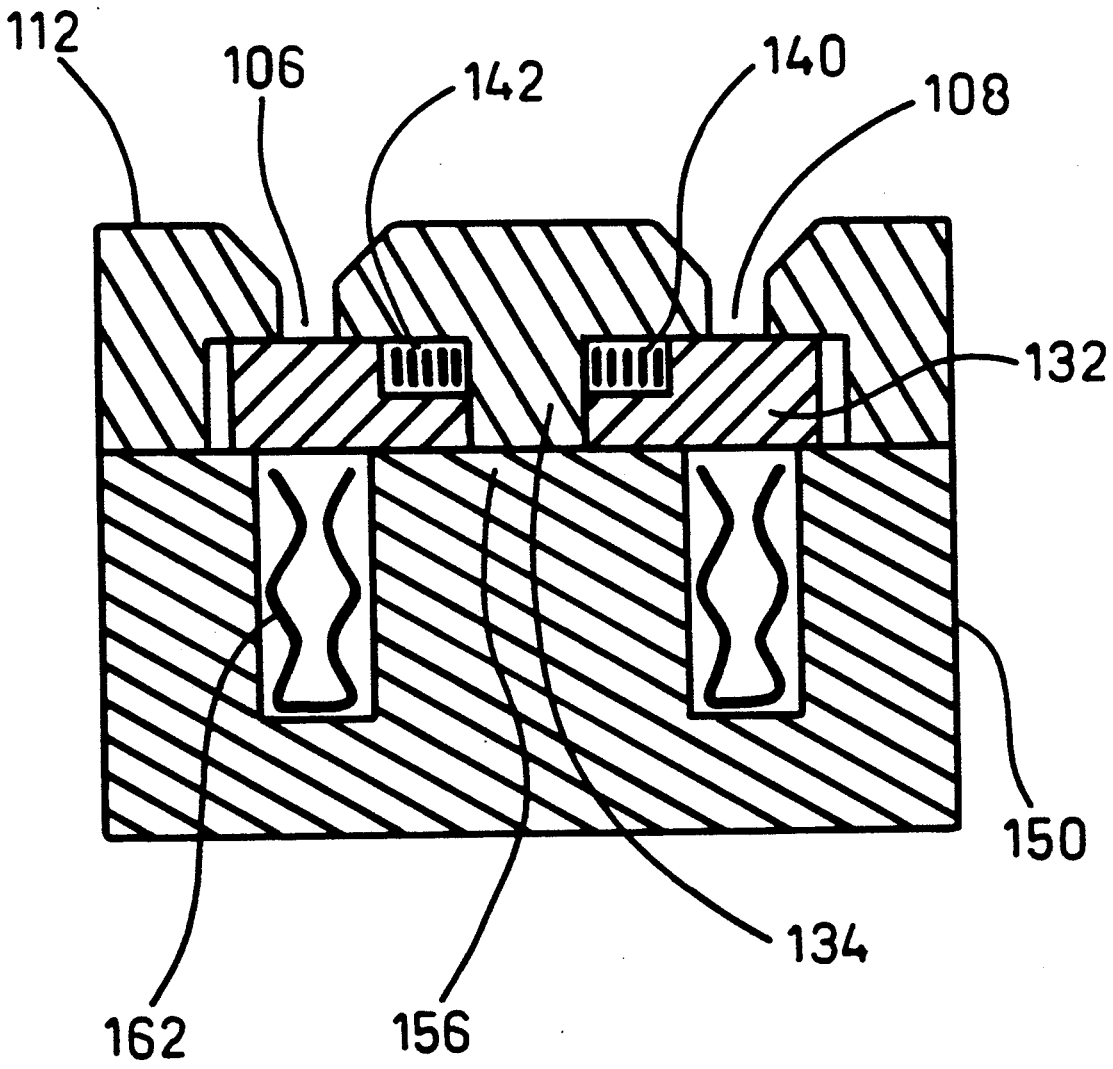
FIG. 10 shows a cross section of the receptacle assembly shown in FIG. 9, and pertains to the first embodiment, taken along the reference line 10—10.

Continuing now with FIG. 9, a frontal plan view of receptacle housing assembly 160 is shown with section lines —10—10— which divide the receptacle housing assembly 160 by a horizontal plane. The resulting cross section taken at the section line is illustrated in FIG. 10. The significance of this illustration principally regards embodiments of this invention which utilize rotating shutter members, and more specifically, regarding the first embodiment, in which the shutter utilizes an axle about which pivoting occurs. In order to prevent the pivoting shutter of this embodiment from sliding off of protruding axle 134, circlips or retaining rings may be present to restrict movement of shutter toward the bottom of this illustration in the axle rearward longitudinal direction. In the absence of such retaining elements, an abutment 156 adjacent to the rearward end of said protruding axle 134 of sectional dimensions greater than said protruding axle end would prevent the pivoting shutter from sliding rearward. Continuing with FIG. 10, and identifying the principal parts therein, we have frontal cover member 112, receptacle housing 150, protruding axle 134, pivoting shutter 132, shutter spring cavity 142, torsion spring 140, and electrical terminal contacts 162.

Figure 11:
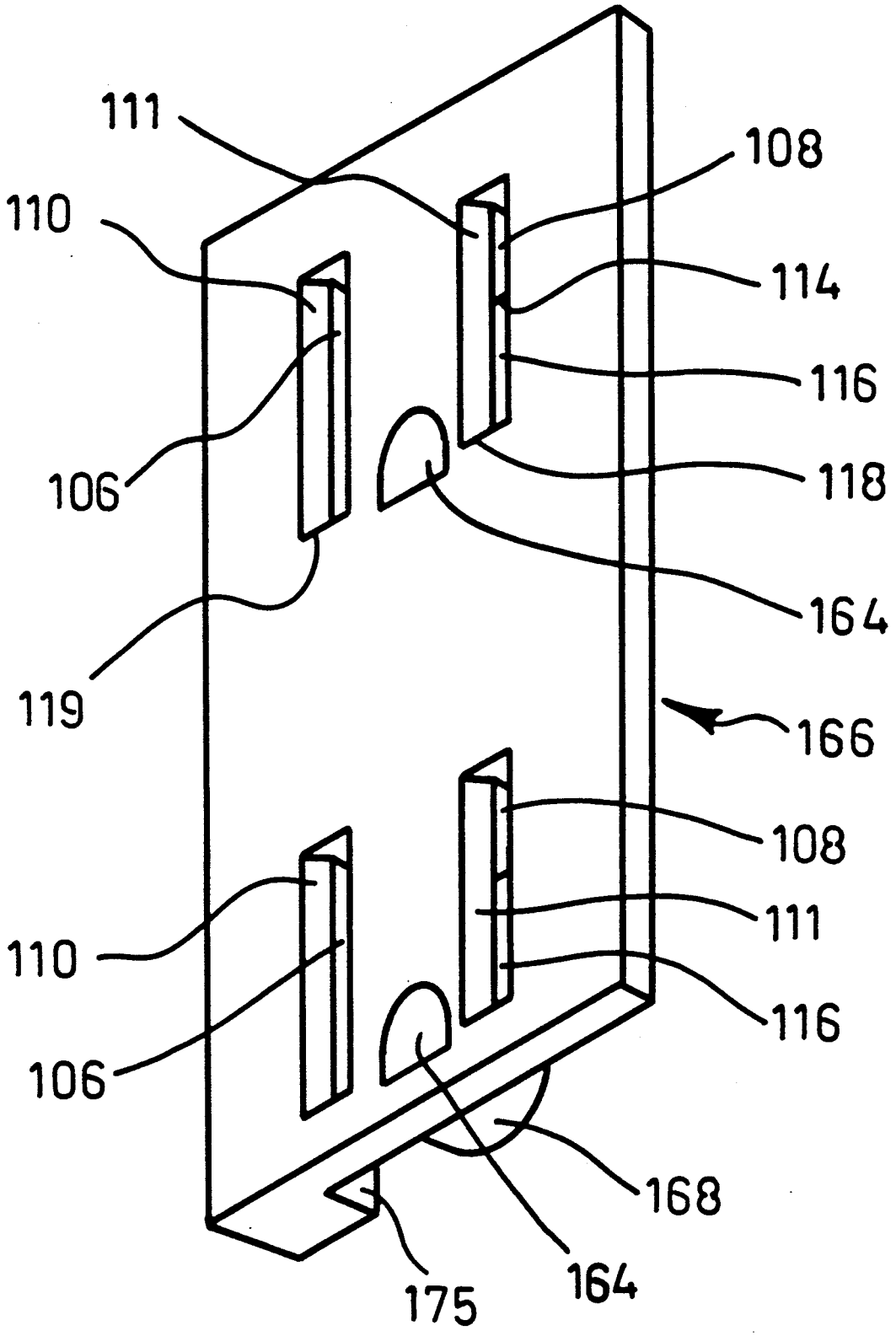
FIG. 11 is an assembled front perspective view of the third embodiment.
Figure 12:
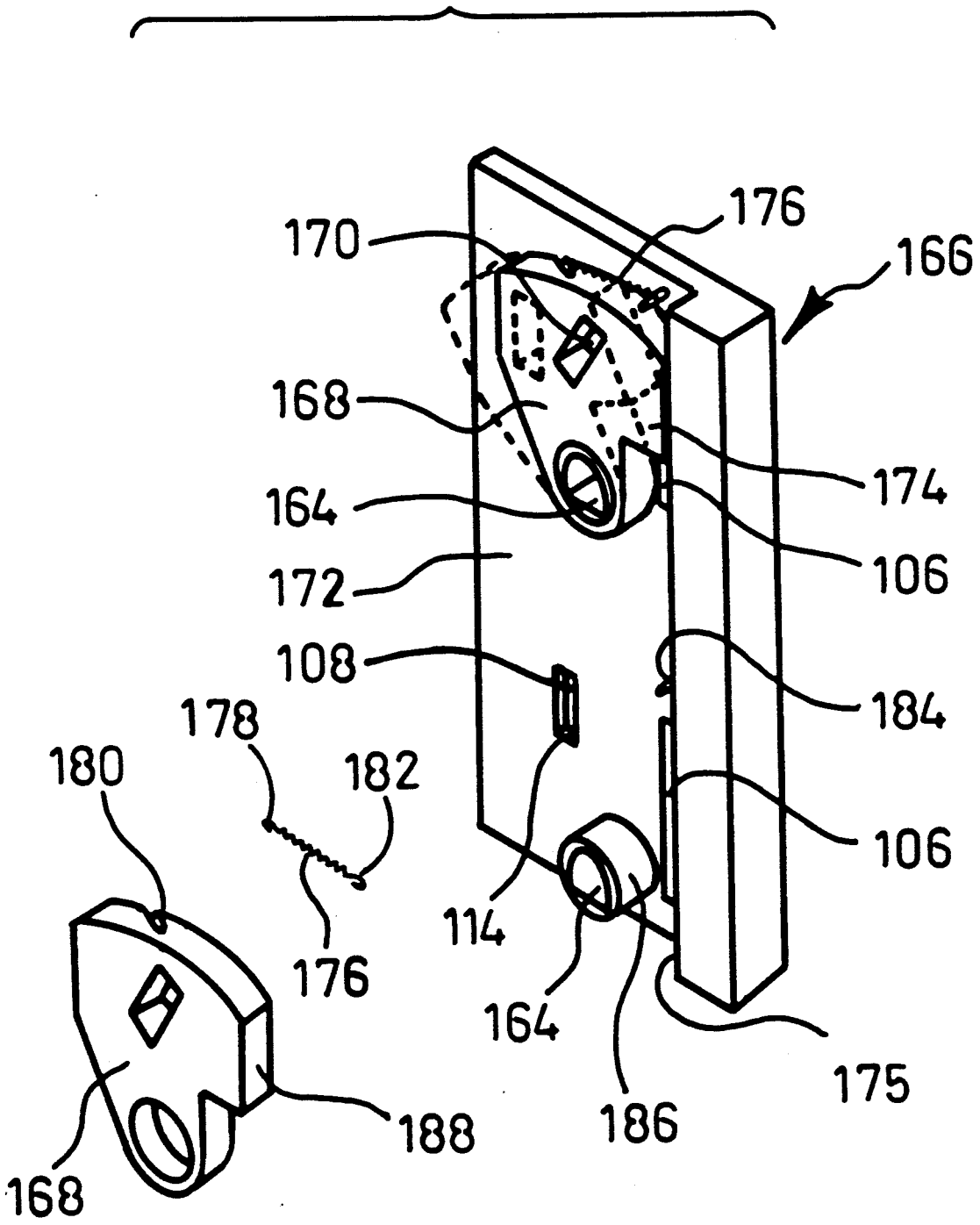
FIG. 12 is a reverse perspective view of the third embodiment shown with the upper portion of the frontal cover member assembled, and with the lower portion of the frontal cover member illustrated in an exploded representation.
Figure 13:
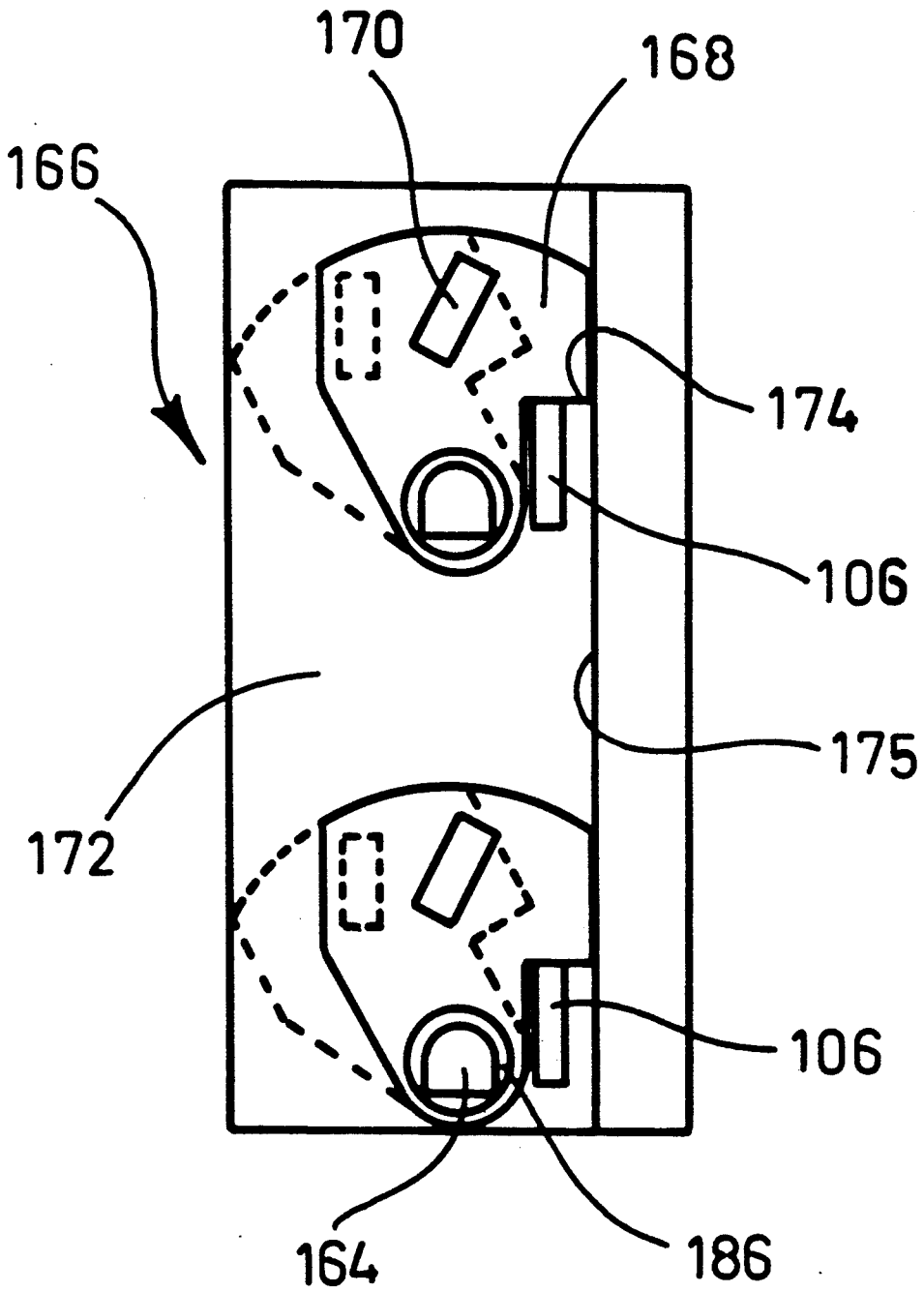
FIG. 13 is an assembled reverse plan view of the third embodiment.

Having discussed the first two embodiments of this invention, we will now direct our attention to a third embodiment as represented in FIG. 11, FIG. 12, and FIG. 13. This embodiment will utilize a pivoting shutter member; however, the pivot point of the shutter will be centered about the ground prong hole. The placement of this pivot point at such a distance from that shown in the first or second embodiment will necessitate the incorporation of a slot in the pivoting shutter member which will become aligned with the positive receptacle housing slot when the shutter is in the open position. In describing this embodiment, we will first refer to FIG. 11, which is a frontal assembled perspective view of this third embodiment. This figure in most respects is identical with the frontal perspective view of the first embodiment illustrated in FIG. 1. I will repeat the commonalities first followed by distinctions between FIG. 1 and FIG. 11.

Commonalities would include neutral prong slot 106, bottom neutral slot end 119, positive prong slot 108, positive trench bottom 116, bottom positive groove end 118, positive slot ledge 114, and slot chamfers 110 and 111.

Distinctions between FIG. 1 and FIG. 11, apart from the fact that the power plug is not shown, will now be discussed. First, regarding the ground prong hole 164, this hole is serving not only as an access hole for the power plug ground prong to the receptacle ground contact; but also, the material associated with and surrounding this ground prong hole at the rear of the frontal cover member acts as a journal, about which the shutter pivots. Pivoting shutter 168 is visible in the vicinity which surrounds this journal. Continuing with FIG. 11, the rear surface of frontal cover member 166 has been reconfigurated to provide for a shutter side stop 175 when shutter 168 is in the normally closed position.

Referring now to FIG. 12, we have a rear perspective view of this third embodiment. The upper half of FIG. 12 is shown assembled, while the lower half of this figure is shown exploded. Pivoting shutter 168 is shown in the upper portion of this view with solid lines representing the normally closed position, and with phantom lines indicating the shutter open position. Continuing to refer specifically to the upper assembled detail of FIG. 12, shutter slot 170 is seen to become aligned with the receptacle positive prong slot when said shutter is torqued to the open position. The greater depth of ground prong hole 164 beyond the rear surface 172 of frontal cover member 166 is evident and may be seen in this assembled portion to be flush with the rear side of pivoting shutter member 168. Prior to opening the shutter, power plug neutral prong must be inserted into the lower portion of frontal cover member neutral slot 106, in the same manner as the first embodiment, in order to contact and force shutter proximal extension 174 upward, until positive shutter slot 170 is in alignment with frontal cover member positive slot 108. Thereafter, power plug may be completely inserted. Upon removal of power plug from receptacle, shutter will return to the normally closed position due to bias force exerted by the shutter return spring 176, until contact occurs between shutter side 188 and shutter side stop 175.

Directing ones attention to the lower exploded detail of FIG. 12, spring 176 is anchored at distal end 178 to shutter hook 180, and at opposite distal end 182 to rear surface 172 of frontal cover member at protruding peg 184. Shutter 168 is illustrated unassembled from the rear surface 172 of frontal cover member as it would appear if it was oriented to the normally closed position. Positive prong hole 108 and neutral prong slot 106 is viewed unobstructed by shutter 168. Positive prong slot ledge is again identified as 114. Ground prong slot journal 186 is clearly represented and is shown to extend beyond the rear surface 172 of frontal cover member to a distance which would become approximately flush with the rear side of shutter 168 when said shutter is assembled to the rear surface 172 of frontal cover member 166.

Referring now to FIG. 13, a rear plan view of this third embodiment is shown which accurately illustrates the geometrical relationships associated with the pivoting motion of shutter member 168. Operational position of shutter 168 is illustrated in a similar fashion as that shown in FIG. 12, where solid lines indicate a closed position, and phantom lines indicate an open shutter position. In the closed orientation, shutter positive slot 170 is out of alignment with frontal cover member positive slot, and likewise becomes in alignment with said frontal cover member positive slot after the shutter 168 has been actuated to the open position. Lower region of frontal cover member neutral slot 106 shown is that into which power plug neutral prong must enter through the frontal cover member 166, early in the technique of power plug insertion.

Continuing briefly with FIG. 13, ground prong slot journal 186 is illustrated surrounding ground prong hole 164 which extends rearward from the rear surface 172 of frontal cover member 166. Additionally, frontal cover member rear internal side shutter stop 175 is shown to define a plane perpendicular to the frontal cover member rear surface 172. Finally, in reference to FIG. 13, it should be recognized that this embodiment could be modified such that the shutter be confined within arcuate surfaces, in much the same principle as FIG. 6, and yet still allow the pivot point to remain centered about ground prong hole, as FIG. 13 functionally depicts.

Figure 14:
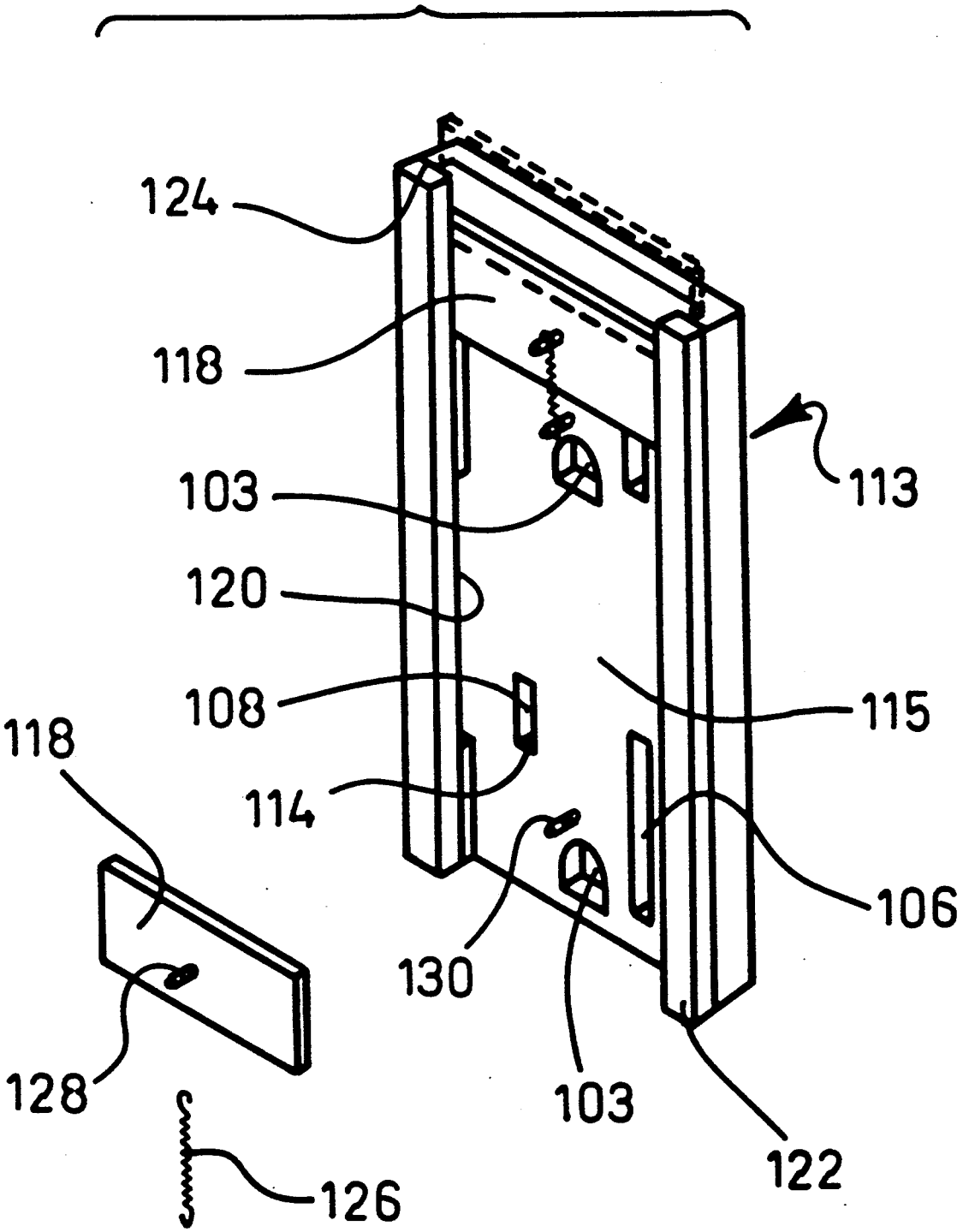
FIG. 14 is a reverse perspective view of the fourth embodiment shown with the upper portion assembled, and with the lower portion exploded.

Directing attention now to FIG. 14, a reverse perspective view is shown which represents the fourth embodiment. The upper half of this view is shown assembled, while the lower half is shown exploded. The vertically sliding shutter members 118 are contained within the frontal cover member 113 by groove raceways 120 present at each side, for each of the two shutters. Shutter member 118 slides upward upon contact and subsequent applied force of power plug neutral prong 102. This shutter member 118 is represented in the upper portion of this figure with solid lines signifying a closed shutter position, and with phantom lines to indicate the biased open position. In the open shutter position, the power plug prongs 102 and 104 (illustrated only in FIG. 1) would protrude through the frontal cover member 113 in order to make contact with unillustrated electrical sockets within the receptacle housing. Ground prong hole 103 is not obstructed at any time by shutter member 118.

During the manufacture of frontal cover member 113, it may be necessary to bond or fasten rear abutment 122 by adhesives or rivets due to geometrical restrictions during the molding of the frontal cover member 113. The bonding site between the rear abutment 122 and the frontal cover member is shown at interface 124.

Continuing with the upper assembled portion of FIG. 14, it is shown that shutters 118 slide upward when at an open position, and that during removal of the power plug, they return downward to a closed position. If the frontal cover member is oriented vertically as shown, with the ground prong hole 103 located at the bottom, the shutter members 118 would be expected to return down to a closed position by the force of gravity alone. However, because of friction, and because occasionally the duplex receptacle may be oriented horizontally, it is desirable to incorporate a tension spring 126 to exert closure force upon shutter member 118. Alternate springs may be employed such as compression or torsion, suitably located to accomplish the same result.

Referring now to the lower exploded portion of FIG. 14, ledge 114 may be viewed as defining the bottom side of positive slot 108. One end of spring 126 is to be hooked and anchored at shutter spring anchor peg 128, while the opposite end of spring 126 is to be anchored at the rear surface 115 of frontal cover member 113 at spring anchor peg 130. It should be reemphasized that this is just one possible method of causing the shutter member 118 to return to the closed position by spring force, and that other spring styles may be employed in combination with an appropriate means to secure and exercise any of such springs to accomplish the same purpose.

With all four of the embodiments presented, design modifications may be in order to further simplify the power plug insertion technique. These modifications may for example include channelling the frontal cover member front surface immediately below the ground prong hole to facilitate ground prong insertion.

This concludes the description of the invention, and while the above description contains many specificities, these should not be construed as limitations on the scope of the invention, but rather as an exemplification of several of the preferred embodiments there of. Accordingly, the scope of the invention should not only be determined by the embodiments illustrated, but also by the appended claims and their legal equivalents.

What is claimed is:

1. A frontal cover member for an electrical receptacle having a pair of electrical terminal contacts to receive prongs of an electrical plug, a pair of parallel slots in said cover member, each slot having an end portion overlying one of said contacts underlying the cover member, a shutter movable on the inside of said cover member to normally close said end portions of said slots, the opposite end portion of one of said slots being closed on the inside surface of the cover member whereby said prongs may be inserted in said opposite end portions of said slots and said plug tilted toward the opposite slot and moved away from said opposite end portions of the slots causing one of said prongs to engage and open the shutter and allow the prongs to be moved out of tilted position and both of said prongs inserted into said terminal contacts.

2. A cover member as defined in claim 1, one side of one slot having a chamfer and the corresponding side of the opposite slot having a chamfer to facilitate said tilting of the plug.

3. A cover member as defined in claim 1, said shutter being slidable in the direction of the slots.

4. A cover member as defined in claim 1, said shutter being rotatable about a pivot between said slots.

5. A cover member as defined in claim 1, said one slot being adapted to receive the power prong and said opposite slot being adapted to receive the neutral prong of a power plug also having a ground prong, a hole in said cover member to receive said ground prong, and a journal on said cover member surrounding said hole to pivotally support said shutter.

6. A cover member as defined in claim 1, said one slot being adapted to receive the power prong and said opposite slot being adapted to receive the neutral prong of a power plug, the side of said one slot adjacent the opposite slot having a chamfer and the side of said opposite slot remote from said one slot having a chamfer, said chamfers facilitating the tilting of the plug away from said one slot.

7. A cover member as defined in claim 1, said shutter being rotatable in a circumferential recess wall in said cover member.

8. A front cover member for an electrical receptacle having a pair of electrical terminal contacts to receive prongs of an electrical plug, said cover member having a pair of parallel slots, a first contact of said pair of electrical terminal contacts, a second contact of said pair of electrical terminal contacts, a first slot of said pair of slots, a second slot of said pair of slots, an end portion of said first slot overlying said first contact underlying the cover member, an opposite end portion of said first slot remote from said first contact, a shutter movable on the inside of said cover member to normally close said end portion of said first slot, a second slot overlying said second contact underlying the cover member, said shutter movable on the inside of said cover member to normally close said second slot, whereby a first prong of the plug may be inserted in said opposite end portion of said first slot and the plug tilted toward said first slot and moved away from said opposite end portion of said first slot in the direction of said first slot causing the first prong to engage and open said shutter and allow the plug to be moved out of tilted position and both of the prongs inserted into said terminal contacts.

9. A cover member as defined in claim 8, said shutter being slidable in the direction of the slots.

10. A cover member as defined in claim 8, said shutter being rotatable about a pivot between said slots.

11. A cover member as defined in claim 8, said second slot being adapted to receive the power prong and said first slot being adapted to receive the neutral prong of a power plug also having a third prong, a hole in said cover member to receive the third prong, said hole overlying a ground electrical contact, and a journal on said cover member surrounding said hole to pivotally support said shutter.

12. A cover member as defined in claim 8, said second slot being adapted to receive the electrically live prong and said first slot being adapted to receive the neutral prong of the power plug.

13. A cover member as defined in claim 8, said second slot being adapted to receive the electrically live power prong and said first slot being adapted to receive the neutral prong of the power plug, the side of said second slot adjacent said first slot having a chamfer and the side of said first slot remote from said second slot having a chamfer, said chamfers facilitating the tilting of the plug away from said second slot.

14. A cover member as defined in claim 8, said shutter being rotatable in a circumferential recess wall in said cover member.

* * * * *